US010677008B2

(12) United States Patent
Xu et al.

(10) Patent No.: US 10,677,008 B2
(45) Date of Patent: Jun. 9, 2020

(54) DOWNHOLE TOOLS AND METHODS OF CONTROLLABLY DISINTEGRATING THE TOOLS

(71) Applicants: YingQing Xu, Tomball, TX (US); Zhihui Zhang, Katy, TX (US); Rajani Satti, Spring, TX (US); Levi Oberg, Houston, TX (US); Derek Shelby Bale, Cypress, TX (US); Kim Ann Noren, Houston, TX (US); Dawne Doxey, Cypress, TX (US)

(72) Inventors: YingQing Xu, Tomball, TX (US); Zhihui Zhang, Katy, TX (US); Rajani Satti, Spring, TX (US); Levi Oberg, Houston, TX (US); Derek Shelby Bale, Cypress, TX (US); Kim Ann Noren, Houston, TX (US); Dawne Doxey, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 176 days.

(21) Appl. No.: 15/446,231

(22) Filed: Mar. 1, 2017

(65) Prior Publication Data

US 2018/0252063 A1 Sep. 6, 2018

(51) Int. Cl.
*E21B 29/02* (2006.01)

(52) U.S. Cl.
CPC ..... *E21B 29/02* (2013.01)

(58) Field of Classification Search
CPC ..... E21B 43/11–1195; E21B 29/02
See application file for complete search history.

(56) References Cited

U.S. PATENT DOCUMENTS 2,080,875 A * 5/1937 Pitzer ..... C09K 8/536 166/299
2,284,969 A * 6/1942 Adkison ..... E21B 33/134 166/264
2,641,185 A * 6/1953 Lockett ..... E21B 43/11855 102/205

(Continued)

FOREIGN PATENT DOCUMENTS

WO 2015139111 A1 9/2015
WO 2015187524 A1 12/2015

OTHER PUBLICATIONS

International Search Report, International Application No. PCT/US2018/016416, dated Apr. 27, 2018, Korean Intellectual Property Office; International Search Report 3 pages.

(Continued)

*Primary Examiner* — William D Hutton, Jr.
*Assistant Examiner* — Steven A MacDonald
(74) *Attorney, Agent, or Firm* — Cantor Colburn LLP

(57) ABSTRACT

A method of controllably disintegrating a downhole article comprises disposing a first article in a downhole environment, the first article being the downhole article to be disintegrated; disposing a second article in the downhole environment after the first article is disposed, the second article carrying a device, a chemical, or a combination comprising at least one of the foregoing; and disintegrating the first article with the device, chemical, or the combination comprising at least one of the foregoing from the second article.

21 Claims, 7 Drawing Sheets

(56) References Cited

U.S. PATENT DOCUMENTS 2,955,533 A * 10/1960 Martinez, Jr. ..... E21B 43/117 102/318
4,378,844 A * 4/1983 Parrish ..... F42D 1/04 102/313
4,614,156 A * 9/1986 Colle, Jr. ..... E21B 43/116 102/275.11
4,656,944 A * 4/1987 Gonzalez ..... E21B 1/00 102/202
4,678,037 A 7/1987 Smith
8,235,102 B1 * 8/2012 Robertson ..... E21B 17/06 166/297
8,297,364 B2 * 10/2012 Agrawal ..... E21B 43/112 166/376
8,327,926 B2 * 12/2012 Robertson ..... E21B 17/06 166/297
8,528,633 B2 9/2013 Agrawal et al.
8,668,019 B2 * 3/2014 Casciaro ..... E21B 44/00 166/292
9,057,242 B2 * 6/2015 Mazyar ..... E21B 41/00
9,101,978 B2 * 8/2015 Xu ..... B22F 1/02
9,617,829 B2 * 4/2017 Dale ..... E21B 23/00
9,835,016 B2 * 12/2017 Zhang ..... E21B 43/14
2002/0007949 A1 * 1/2002 Tolman ..... E21B 33/124 166/308.1
2002/0148611 A1 * 10/2002 Williger ..... E21B 33/10 166/297
2003/0075325 A1 * 4/2003 Dusterhoft ..... E21B 43/04 166/279
2005/0205264 A1 * 9/2005 Starr ..... E21B 33/12 166/376
2007/0246227 A1 * 10/2007 Ezell ..... E21B 23/06 166/387
2011/0005759 A1 * 1/2011 Xu ..... E21B 43/112 166/308.1
2012/0193143 A1 * 8/2012 Hill ..... E21B 43/119 175/4.51
2012/0318513 A1 * 12/2012 Mazyar ..... C25D 5/48 166/304
2013/0048305 A1 * 2/2013 Xu ..... E21B 23/01 166/376
2013/0206425 A1 * 8/2013 Mazyar ..... E21B 33/12 166/376
2013/0240203 A1 * 9/2013 Frazier ..... E21B 33/129 166/193
2014/0124216 A1 * 5/2014 Fripp ..... E21B 33/1208 166/376
2014/0202712 A1 * 7/2014 Fripp ..... E21B 33/12 166/377
2015/0159462 A1 * 6/2015 Cutler ..... E21B 33/12 166/377
2015/0184486 A1 * 7/2015 Epstein ..... E21B 34/14 166/193
2015/0247376 A1 * 9/2015 Tolman ..... E21B 33/12 166/297
2015/0285024 A1 * 10/2015 Sanchez ..... E21B 33/128 166/285
2015/0285026 A1 * 10/2015 Frazier ..... E21B 33/1291 166/120
2015/0337615 A1 * 11/2015 Epstein ..... E21B 33/1208 166/65.1
2016/0123129 A1 * 5/2016 Sanchez ..... E21B 23/00 166/250.04
2016/0201427 A1 * 7/2016 Fripp ..... E21B 33/134 166/297
2016/0333660 A1 * 11/2016 Dedman ..... E21B 33/12
2016/0333668 A1 11/2016 Xu et al.
2017/0022778 A1 * 1/2017 Fripp ..... E21B 33/134
2017/0328160 A1 * 11/2017 Arnaly ..... E21B 29/00
2018/0258722 A1 * 9/2018 Allen ..... E21B 29/02
2019/0032435 A1 * 1/2019 Kochanek ..... E21B 29/02

OTHER PUBLICATIONS

International Written Opinion, International Application No. PCT/US2018/016416, dated Apr. 27, 2018, Korean Intellectual Property Office; International Written Opinion 8 pages.

* cited by examiner

DOWNHOLE TOOLS AND METHODS OF CONTROLLABLY DISINTEGRATING THE TOOLS

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating or interventionless downhole tools have been developed. Instead of milling or drilling operations, these tools can be removed by dissolution of engineering materials using various wellbore fluids. Because downhole tools are often subject to high pressures, a disintegrable material with a high mechanical strength is often required to ensure the integrity of the downhole tools. In addition, the material must have minimal disintegration initially so that the dimension and pressure integrities of the tools are maintained during tool service. Ideally the material can disintegrate rapidly after the tool function is complete because the sooner the material disintegrates, the quicker the well can be put on production.

One challenge for the self-disintegrating or interventionless downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainty associated with the disintegration period and the change of tool dimensions during disintegration can cause difficulties in well operations and planning. An uncontrolled disintegration can also delay well productions. Therefore, the development of downhole tools that have minimal or no disintegration during the service of the tools so that they have the mechanical properties necessary to perform their intended function and then rapidly disintegrate is very desirable.

BRIEF DESCRIPTION

A method of controllably disintegrating a downhole article comprises disposing a first article in a downhole environment, the first article being the downhole article to be disintegrated; disposing a second article in the downhole environment after the first article is disposed, the second article carrying a device, a chemical, or a combination comprising at least one of the foregoing; and disintegrating the first article with the device, chemical, or the combination comprising at least one of the foregoing from the second article.

A method of controllably disintegrating a downhole article comprises disposing a downhole article in a downhole environment, the downhole article including: a matrix material comprising Zn, Mg, Al, Mn, an alloy thereof, or a combination comprising at least one of the foregoing; and a device attached to or embedded in the downhole article, the device being configured to facilitate the disintegration of the downhole article; and activating the device to disintegrate the article.

A downhole assembly comprises an article including: a matrix material comprising Zn, Mg, Al, Mn, an alloy thereof, or a combination comprising at least one of the foregoing; and a device attached to or embedded in the article, the device being configured to facilitate the disintegration of the article.

BRIEF DESCRIPTION OF THE DRAWINGS

The following descriptions should not be considered limiting in any way. With reference to the accompanying drawings, like elements are numbered alike:

FIG. 1A-FIG. 1G illustrate an exemplary method of disintegrating a downhole article, wherein FIG. 1A shows a first article disposed in a wellbore; FIG. 1B shows that a fracturing operation is performed; FIG. 1C shows that a second article carrying a device or chemical is disposed in the wellbore; FIG. 1D shows that the device or chemical is released from the second article; FIG. 1E shows that the second article generates a signal to activate the device; FIG. 1F shows that a pressure is applied against the chemical to release a corrosive material; and FIG. 1G shows that the first article has been removed.

FIG. 2A-FIG. 2C illustrate another exemplary method of disintegrating a downhole article, wherein FIG. 2A shows a first article and a second article disposed proximate to the first article, the second article carrying a device that facilitates the disintegration of the first article; FIG. 2B shows that the first article is broken into pieces by the device on the second article; and FIG. 2C shows that the first article is removed.

FIG. 3A-FIG. 3D illustrate still another exemplary method of disintegrating a downhole article, wherein FIG. 3A shows that a first article having a device embedded therein is disposed in a wellbore; FIG. 3B shows that a fracturing operation is performed; FIG. 3C shows that a second article having a transmitter is disposed in the wellbore, the transmitter generating a signal to active the device in the first article; and FIG. 3D shows that the disintegrable article is removed after the embedded device is activated.

DETAILED DESCRIPTION

Figure 1A:
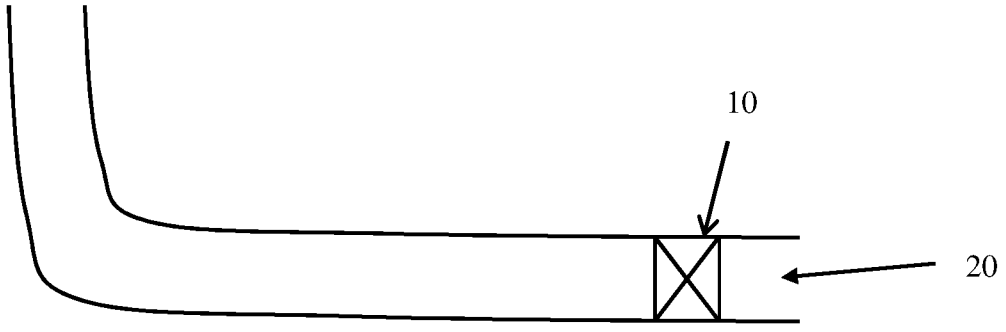
Figure 1B:
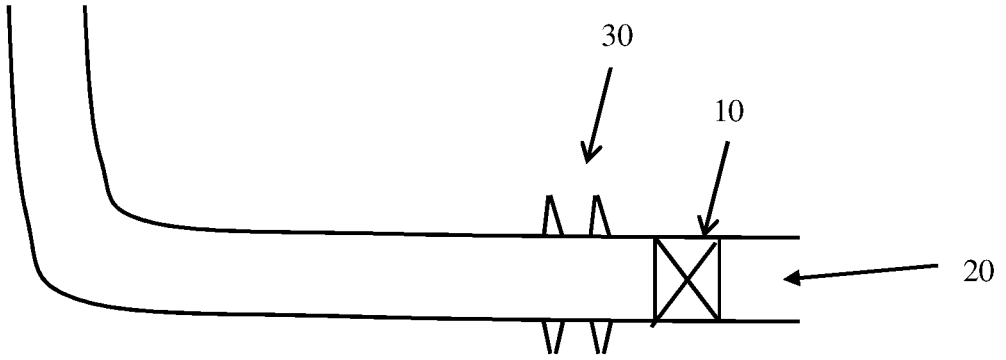
Figure 1C:
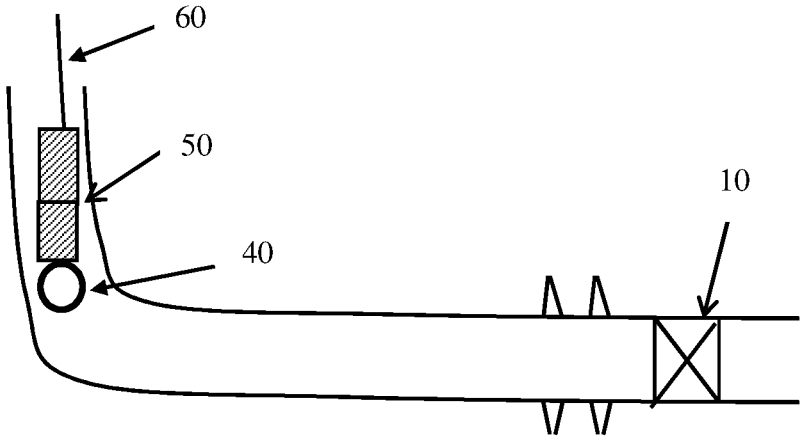
Figure 1D:
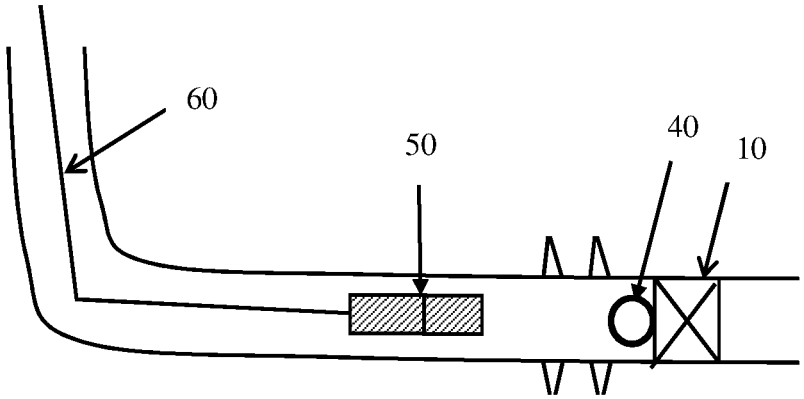
Figure 1E:
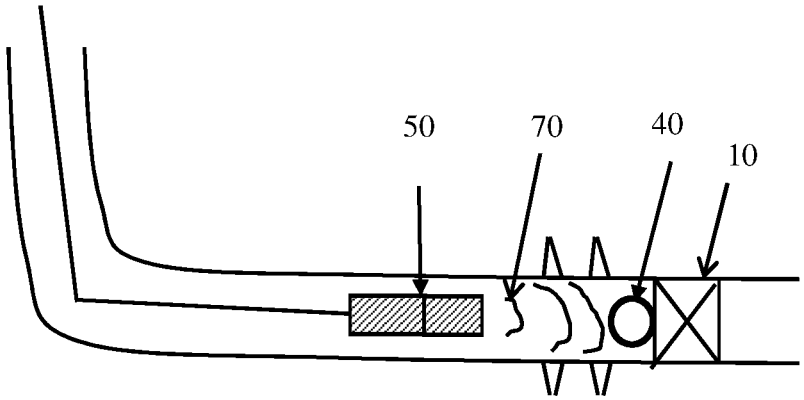
Figure 1F:
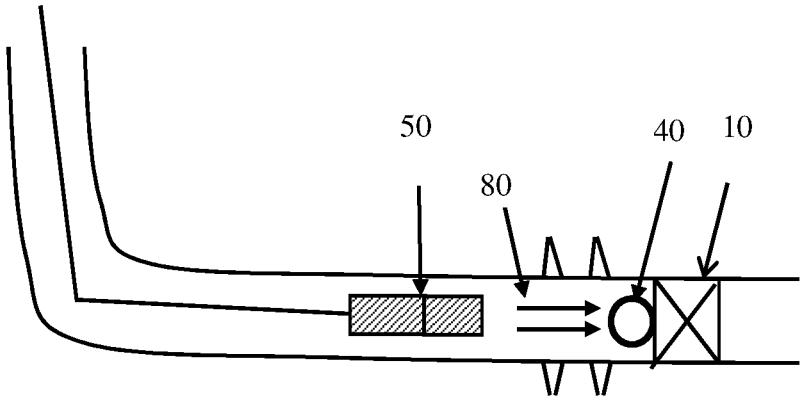
Figure 1G:
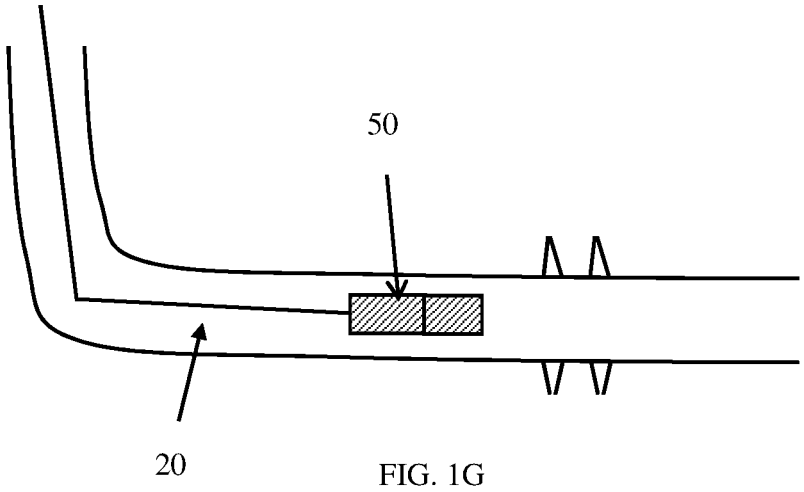

The disclosure provides methods that are effective to delay or reduce the disintegration of various downhole tools during the service of the tools but can activate the disintegration process of the tools after the tools are no longer needed. The disclosure also provides a downhole assembly that contains a disintegrable article having a controlled disintegration profile.

In an embodiment, a method of controllably disintegrating a downhole article comprises disposing a first article in a downhole environment, the first article being the downhole article to be disintegrated; disposing a second article in the downhole environment after the first article is disposed, the second article carrying a device, a chemical, or a combination comprising at least one of the foregoing; and disintegrating the first article with the device, chemical, or the combination comprising at least one of the foregoing from the second article.

The downhole article to be disintegrated comprises a metal, a metal composite, or a combination comprising at least one of the foregoing. The material for the downhole article is selected such that the article has minimal or controlled corrosion in a downhole environment. In a specific embodiment, the downhole article has a corrosion rate of less than about 100 mg/cm$^2$/hour, less than about 10 mg/cm$^2$/hour, or less than about 1 mg/cm$^2$/hour determined in aqueous 3 wt. % KCl solution at 200° F. (93° C.).

Optionally the article has a surface coating such as a metallic layer that is resistant to corrosion by a downhole fluid. As used herein, "resistant" means the metallic layer is not corroded or has minimal controlled corrosion by corrosive downhole conditions encountered (i.e., brine, hydrogen sulfide, etc., at pressures greater than atmospheric pressure, and at temperatures in excess of 50° C.) such that any portion of the article is exposed, for a period of greater than or equal to 24 hours or 36 hours.

A downhole operation is then performed, which can be any operation that is performed during drilling, stimulation, completion, production, or remediation. A fracturing operation is specifically mentioned.

When the downhole article is no longer needed, a second article carrying a device, a chemical, or a combination comprising at least one of the foregoing is disposed in the downhole environment. The device and the chemical on the second article facilitate the disintegration of the first article. Exemplary devices include explosive devices and devices containing explosive charges such as perforation guns. Suitable chemicals include corrosive materials such as solid acids or gelled acids. Exemplary corrosive materials include gelled HCl, gelled $H_2SO_4$, phosphoric acid, niobic acid, $SO_3$, $SO_2$, sulfonated acid, and the like. Combinations of the chemicals can be used. Optionally the chemicals have a shell encapsulating the corrosive chemicals. Exemplary materials for the shell include a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

At the time of disintegrating the first article, the device and the chemical can be delivered from the second article to the first article. There are several ways to deliver the device and the chemical from the second article to the first article. In an embodiment, the second article carrying the device, the chemical, or a combination comprising at least one of the foregoing is disposed proximate to the first article via a casing string, for example, the second article travels down a wellbore and stops at the top of the first article. Then the device, the chemical, or a combination comprising at least one of the foregoing is released from the second article. After the device and the chemical are released, the second article is pulled to a safe distance away from the first article so that the second article is not affected by the conditions that disintegrate the first article. In another embodiment, the second article travels down a wellbore and stops at a safe distance away from the first article, then the device, the chemical, or a combination comprising at least one of the foregoing is released from the second article. A pressure applied to the downhole environment can subsequently carry the device and the chemical to the first article.

After the device such as an explosive device is delivered to the first article, the device can be activated by a timer or a signal transmitted from the second article to the explosive device. The timer can be part of the explosive device. In the instance where the explosive device is triggered by a signal received from the second article, the second article can include a transmitter that is effective to generate a command signal, and the explosive device can have a receiver that receives and processes such a command signal. The signal is not particularly limited and includes electromagnetic radiation, an acoustic signal, pressure, or a combination comprising at least one of the foregoing. Upon the activation of the explosive device, the downhole article can break into discrete pieces, which can further corrode in a downhole fluid and completely disintegrate or flow back to the surface of the wellbore.

In the event that a chemical is delivered to the article to be disintegrated, the corrosive material in the chemical can be released when a pressure is applied against the chemical. The corrosive material reacts with the article to be removed, and quickly corrodes the article away.

The device on the second article can also be a device containing explosive charges such as a perforation gun. In this embodiment, the device is not released from the second article. When the second article carrying the device is disposed at a suitable distance from the article to be removed, the device breaks the article to be disintegrated into small pieces. The broken pieces can also corrode in a downhole fluid to completely disintegrate or become smaller pieces before carried back to the surface of the wellbore.

The first and second articles are not particularly limited. Exemplary first articles include packers, frac balls, and plugs such as a bridge plug, a fracture plug and the like. Exemplary second articles include a bottom hole assembly (BHA). A BHA can include setting tools, and plugs such as a bridge plug, a fracture plug and the like.

In another embodiment, a device such as an explosive device is attached or embedded in the article to be disintegrated. Once the article or a downhole assembly comprising the same is no longer needed, the device is activated by a timer or a signal received from a second article. The second article can include a transmitter that is effective to generate a command signal, and the explosive device can have a receiver that receives and process such a command signal.

FIG. 1A-FIG. 1G illustrate an exemplary method of disintegrating a downhole article. In the method, a first article 10 is disposed in wellbore 20. A fracturing operation is then performed, creating fractures 30. A second article 50 carrying a device or chemical 40 is disposed in the wellbore. The device or chemical 40 is released from second article 50 and delivered to first article 10. When the device 40 is an explosive device, the second article 50 can generate a signal 70 to activate the device 40. Alternatively when chemical 40 is delivered to first article 10, a pressure 80 is applied to the chemical 40 releasing a corrosive material from the chemical. After the device is activated or after a corrosive chemical is released, article 10 quickly disintegrates.

Figure 2A:
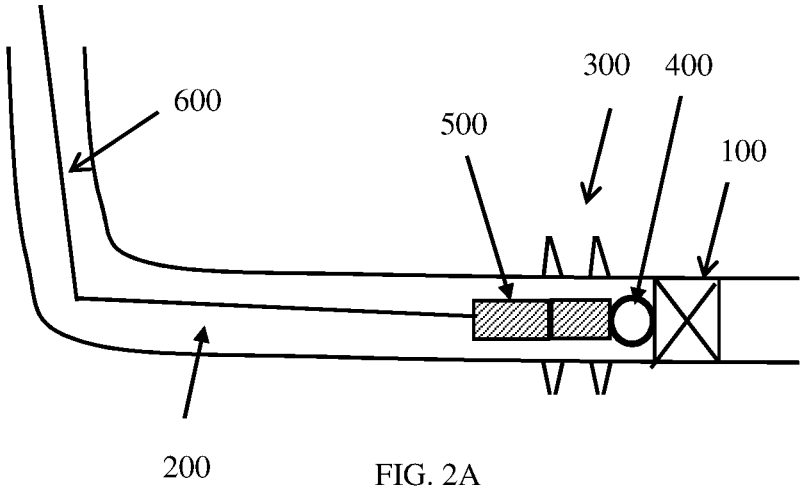
Figure 2B:
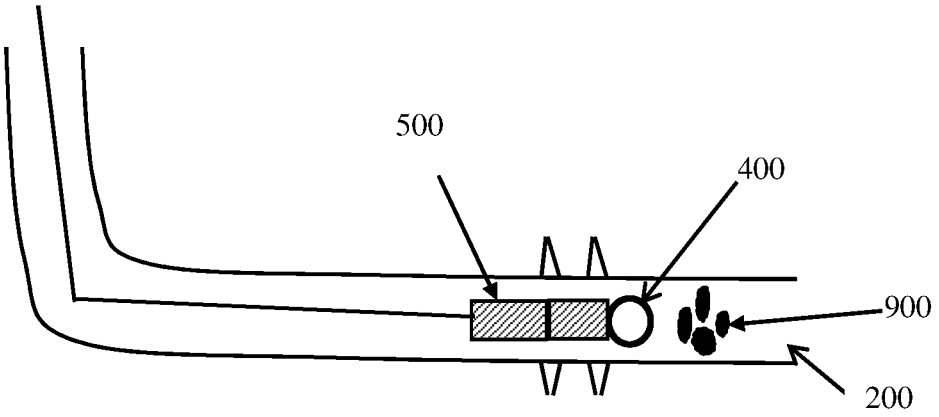
Figure 2C:
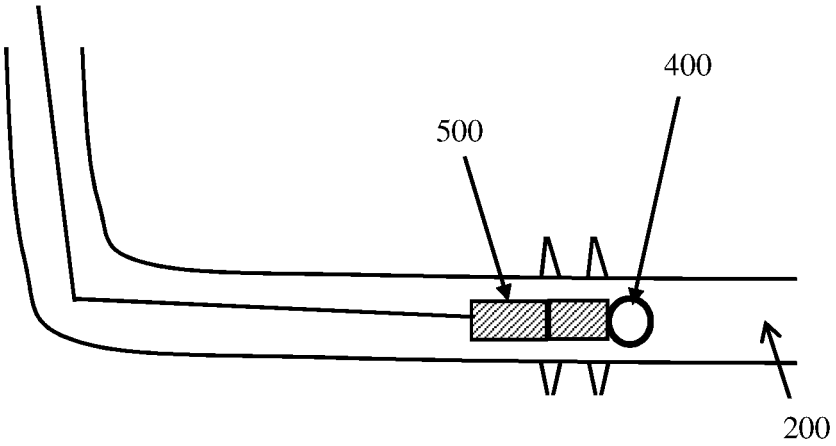
Figure 3A:
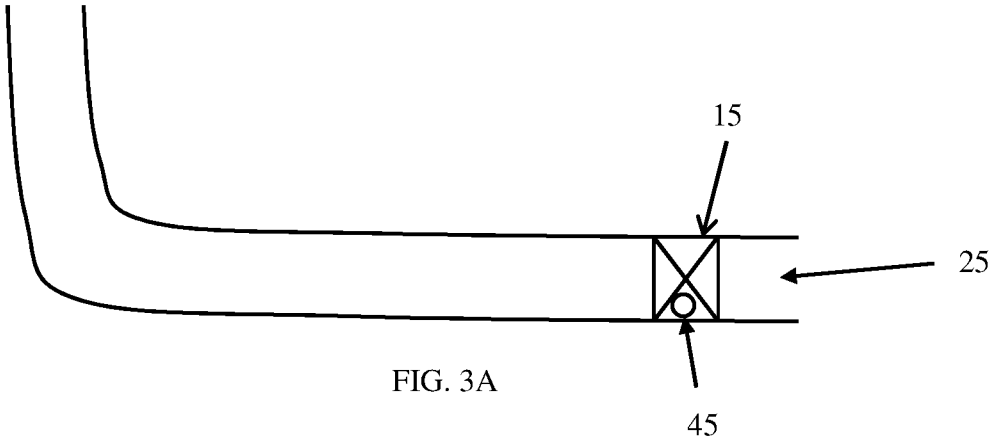
Figure 3B:
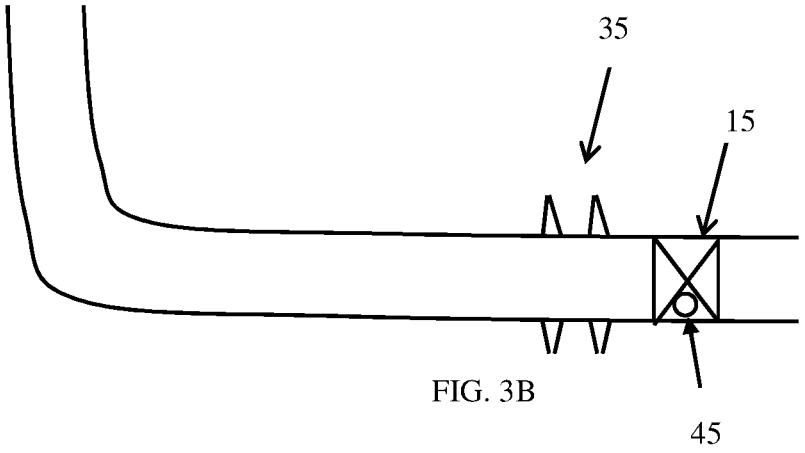
Figure 3C:
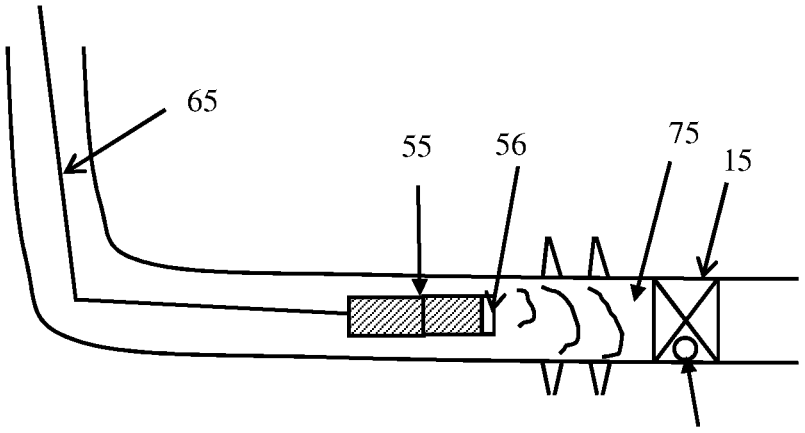
Figure 3D:
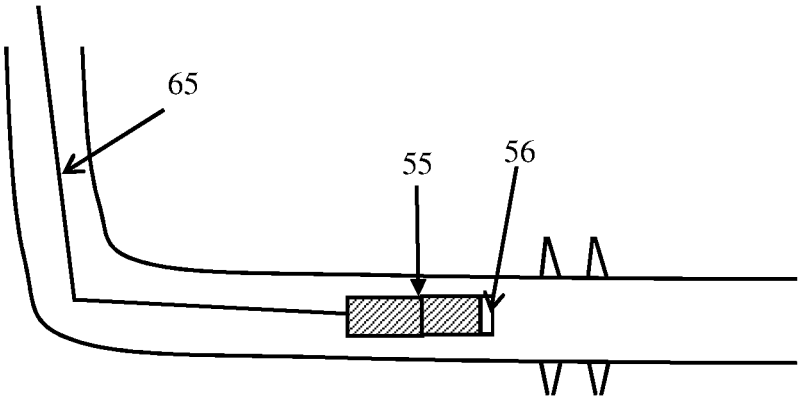

FIG. 2A-FIG. 2C illustrate another exemplary method of disintegrating a downhole article. In the method, a disintegrable article 100 is disposed in wellbore 200. An operation such as a fracturing operation is preformed creating fractures 300. A downhole tool 500 having device 400 is disposed in the wellbore through casing string 600. Once the tool 500 is positioned at a suitable distance away from the disintegrable article 100, device 400, which is a perforation gun for example, can break article 100 into small pieces 900. The broken pieces can be carried back to the surface by downhole fluids. The broken pieces can also corrode in the presence of a downhole fluid to completely disintegrate or become smaller pieces before carried back to the surface of the wellbore.

In the method illustrated in FIG. 3A-FIG. 3D, a disintegrable article 15 having a device 45 embedded therein is disposed in a wellbore 25. A fracturing operation is performed creating fractures 35. A downhole tool 55 having an activating device 56 such as a transmitter is disposed in the wellbore. The activation device can generate signal 75 to activate the device 45. Once the device 45 is activated, the article 15 is disintegrated and subsequently removed from the wellbore.

Figure 4:
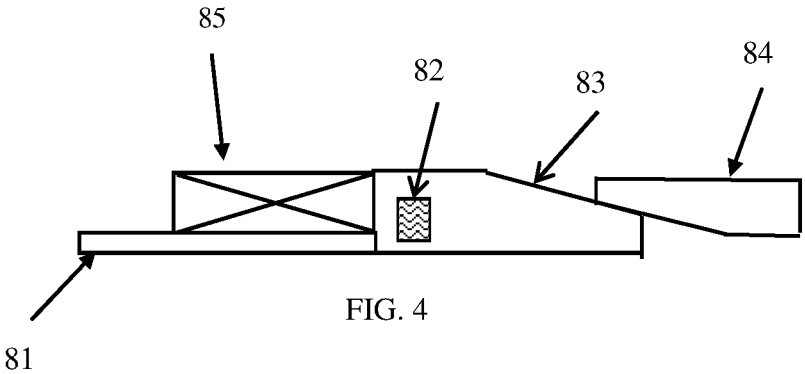
FIG. 4 is a partial cross-sectional view of a downhole assembly comprising an article having an explosive device embedded therein.

FIG. 4 is a partial cross-sectional view of a downhole assembly. The assembly comprises an article having an explosive device embedded therein. As shown in FIG. 4, the downhole assembly includes an annular body 81 having a flow passage therethrough (not shown); a frustoconical element 83 disposed about the annular body 81; a sealing element 85 carried on the annular body 81 and configured to engage a portion of the frustoconical element 83; and a slip segment 84 disposed about the annular body 81. The frustoconical element 83 has an explosive device 82 embedded therein. Once the downhole assembly is no longer needed, the device 82 can be activated. Upon the disintegration of the frustoconical element, the slip loses support causing the downhole assembly to disengage from casing wall.

As described herein, the article to be disintegrated comprises a matrix material, which includes a metal, a metal composite, or a combination comprising at least one of the foregoing. A metal includes metal alloys. The matrix material has a controlled corrosion rate in a downhole fluid, which can be water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

Exemplary matrix materials include zinc metal, magnesium metal, aluminum metal, manganese metal, an alloy thereof, or a combination comprising at least one of the foregoing. The matrix material can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

As used herein, a metal composite refers to a composite having a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the particle core material.

The material can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

Optionally, the matrix material further comprises additives such as carbides, nitrides, oxides, precipitates, dispersoids, glasses, carbons, or the like in order to control the mechanical strength and density of the disintegrable article.

The optional surface coating (metallic layer) on the downhole article to be disintegrated includes any metal resistant to corrosion under ambient downhole conditions, and which can be removed by a downhole fluid in the presence of the chemicals or devices delivered from the second article or attached/embedded in the first article. In an embodiment, the metallic layer includes aluminum alloy, magnesium alloy, zinc alloy or iron alloy. The metallic layer includes a single layer, or includes multiple layers of the same or different metals.

The metallic layer has a thickness of less than or equal to about 1,000 micrometers (i.e., about 1 millimeter). In an embodiment, the metallic layer may have a thickness of about 10 to about 1,000 micrometers, specifically about 50 to about 750 micrometers and still more specifically about 100 to about 500 micrometers. The metallic layer can be formed by any suitable method for depositing a metal, including an electroless plating process, or by electrodeposition.

Set forth below are various embodiments of the disclosure.

Embodiment 1

A method of controllably disintegrating a downhole article, the method comprising: disposing a first article in a downhole environment, the first article being the downhole article to be disintegrated; disposing a second article in the downhole environment after the first article is disposed, the second article carrying a device, a chemical, or a combination comprising at least one of the foregoing; and disintegrating the first article with the device, chemical, or the combination comprising at least one of the foregoing from the second article.

Embodiment 2

The method of Embodiment 1, wherein the device is an explosive device, and the method further comprises releasing the device, the chemical, or a combination comprising at least one of the foregoing from the second article.

Embodiment 3

The method of Embodiment 2, wherein the device, the chemical, or a combination comprising at least one of the foregoing is released from the second article when the second article is disposed proximate to the first article.

Embodiment 4

The method of Embodiment 3, further comprising pulling the second article away from the first article after the device, the chemical, or a combination comprising at least one of the foregoing is released from the second article.

Embodiment 5

The method of Embodiment 2, further comprising applying pressure to the downhole environment to deliver the device, the chemical, or a combination comprising at least one of the foregoing released from the second article to the first article.

Embodiment 6

The method of any one of Embodiments 2 to 5, further comprising activating the explosive device.

Embodiment 7

The method of Embodiment 6, wherein the explosive device is activated by a timer or a signal transmitted from the second article to the explosive device.

Embodiment 8

The method of Embodiment 6 or Embodiment 7, wherein the second article comprises a transmitter, and the explosive device comprises a receiver that is configured to receive a signal sent by the transmitter.

Embodiment 9

The method of Embodiment 8, wherein the signal comprises electromagnetic radiation, an acoustic signal, pressure, or a combination comprising at least one of the foregoing.

Embodiment 10

The method of any one of Embodiments 1 to 9, wherein the chemical comprises a corrosive material encapsulated within a shell.

Embodiment 11

The method of Embodiment 10, wherein the method further comprises releasing the corrosive material from the shell after the chemical is disposed proximate to the first article.

Embodiment 12

The method of Embodiment 11, further comprising applying pressure to the chemical to release the corrosive material.

Embodiment 13

The method of Embodiment 1, wherein the device in the second article is a device containing explosive charges.

Embodiment 14

The method of Embodiment 13, further comprising breaking the first article into a plurality of discrete pieces using the device containing explosive charges.

Embodiment 15

The method of Embodiment 14, further comprising corroding the plurality of discrete pieces with a downhole fluid.

Embodiment 16

The method of any one of Embodiments 1 to 15, wherein the first article comprises Zn, Mg, Al, Mn, an alloy thereof, or a combination comprising at least one of the foregoing.

Embodiment 17

The method of any one of Embodiments 1 to 16, wherein the first article has a surface coating comprising a metallic layer of a metal resistant to corrosion by a downhole fluid.

Embodiment 18

The method of any one of Embodiments 1 to 17, further comprising performing a downhole operation after disposing the first article but before disposing the second article.

Embodiment 19

A method of controllably disintegrating a downhole article, the method comprising: disposing a downhole article in a downhole environment, the downhole article including: a matrix material comprising Zn, Mg, Al, Mn, an alloy thereof, or a combination comprising at least one of the foregoing; and a device attached to or embedded in the downhole article, the device being configured to facilitate the disintegration of the downhole article; and activating the device to disintegrate the downhole article.

Embodiment 20

The method of Embodiment 19, wherein the downhole article has a surface coating comprising a metallic layer of a metal resistant to corrosion by a downhole fluid.

Embodiment 21

The method of Embodiment 19 or Embodiment 20, wherein the device is an explosive device.

Embodiment 22

The method of any one of Embodiments 19 to 21, further comprising disposing a second article in the downhole environment, and activating the device attached to or embedded in the first article with a signal received from the second article.

Embodiment 23

A downhole assembly comprising: an article including: a matrix material comprising Zn, Mg, Al, Mn, an alloy thereof, or a combination comprising at least one of the foregoing; and a device attached to or embedded in the article, the device being configured to facilitate the disintegration of the article.

Embodiment 24

The downhole assembly of Embodiment 23, wherein the article has a surface coating comprising a metallic layer of a metal resistant to corrosion by a downhole fluid.

Embodiment 25

The downhole assembly of Embodiment 23 or Embodiment 24, wherein the device comprises a timer or a receiver that is effective to activate the device.

Embodiment 26

The downhole assembly of any one of Embodiments 23 to 25 further comprising a second article, the second article comprising a transmitter which is configured to generate a signal to activate the device attached to or embedded in the article.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A method of controllably disintegrating a downhole article, the method comprising:

disposing a first article in a downhole environment, the first article being the downhole article to be disintegrated;

disposing a second article in the downhole environment after the first article is disposed, the second article carrying a device;

releasing the device from the second article;

disintegrating the first article with the device released from the second article, whereby the disintegrating comprises:

breaking the first article into a plurality of discrete pieces using the device; and corroding the plurality of discrete pieces with a downhole fluid, wherein the first article is a packer, a frac ball, or a plug, and comprises Zn, Mg, Al, Mn, an alloy thereof, or a combination comprising at least one of the foregoing.

2. The method of claim 1, wherein the device is explosive.

3. The method of claim 2, further comprising activating the device after the device is released from the second article.

4. The method of claim 3, wherein the device is activated by a timer or a signal transmitted from the second article to the device.

5. The method of claim 3, wherein the second article comprises a transmitter, and the device comprises a receiver that is configured to receive a signal sent by the transmitter.

6. The method of claim 5, wherein the signal comprises electromagnetic radiation, an acoustic signal, pressure, or a combination comprising at least one of the foregoing.

7. The method of claim 1, further comprising pulling the second article away from the first article after releasing the device from the second article but before disintegrating the first article with the device.

8. The method of claim 1, further comprising applying a pressure to the downhole environment to deliver the device released from the second article to the first article.

9. The method of claim 1, wherein the first article has a surface coating comprising a metallic layer of a metal resistant to corrosion by a downhole fluid.

10. The method of claim 1, further comprising performing a downhole operation after disposing the first article but before disposing the second article.

11. The method of claim 10, wherein the downhole operation is a drilling, stimulation, completion, production, or remediation.

12. The method of claim 10, wherein the downhole operation is a fracturing operation.

13. The method of claim 1, wherein second article is a bottom hole assembly.

14. The method of claim 1, wherein the second article is a setting tool.

15. The method of claim 1, wherein the second article is a plug.

16. The method of claim 1, wherein the second article is a bridge plug or a fracture plug.

17. A method of controllably disintegrating a downhole article, the method comprising:

disposing a first article in a downhole environment, the first article being the downhole article to be disintegrated;

disposing a second article, which is a plug, in the downhole environment after the first article is disposed, the second article carrying a chemical;

releasing the chemical from the second article; and disintegrating the first article with the chemical released from the second article, wherein disintegrating the first article further comprises breaking the first article into a plurality of discrete pieces using a device containing explosive charges; and corroding the plurality of discrete pieces with a downhole fluid.

18. The method of claim 17, further comprising applying a pressure to the downhole environment to deliver the chemical released from the second article to the first article.

19. The method of claim 17, wherein the first article comprises Zn, Mg, Al, Mn, an alloy thereof, or a combination comprising at least one of the foregoing; and the first article has a surface coating comprising a metallic layer of a metal resistant to corrosion by a downhole fluid.

20. The method of claim 17, wherein the chemical comprises a corrosive material encapsulated within a shell.

21. The method of claim 20, further comprising applying pressure to the chemical to release the corrosive material.

* * * * *